US005138944A

United States Patent [19]

Rancourt et al.

[11] Patent Number: 5,138,944

[45] Date of Patent: Aug. 18, 1992

[54] METHOD AND APPARATUS FOR SETTING RESPECTIVE POSITIONS OF INK KEYS

[75] Inventors: Michael R. Rancourt, Merrimack, N.H.; Eduardo M. Barreda, Miami, Fla.; Stephen P. Fraczek, Lee, N.H.

[73] Assignee: Heidelberg Harris Inc., Dover, N.H.

[21] Appl. No.: 753,801

[22] Filed: Sep. 3, 1991

[51] Int. Cl.[5] ..... B41F 31/04; B41F 31/06; B41F 33/16

[52] U.S. Cl. ..... 101/365; 101/485

[58] Field of Search ..... 101/365, 350, 157, 169, 101/DIG. 47, 45, 485, 483, 366, 484; 118/261

[56] References Cited

U.S. PATENT DOCUMENTS 4,381,708 5/1983 Hirt et al. ..... 101/365
4,803,923 2/1989 Kenichi ..... 101/DIG. 47

FOREIGN PATENT DOCUMENTS 2073663 10/1981 United Kingdom ..... 101/365

*Primary Examiner*—J. Reed Fisher

*Attorney, Agent, or Firm*—Tarolli, Sundheim & Covell

[57] ABSTRACT

Adjustable ink keys are adjusted to move associated portions of a doctor blade relative to associated portions of an ink roll of a printing unit. Each portion of the doctor blade is moved into contact with the associated portion of the ink roll. Each portion of the doctor blade is then moved a predetermined amount away from the associated portion of the ink roll after the portion of the doctor blade has moved into contact with the portion of the ink roll. A measured value associated with the position of the associated ink key is stored in memory. The stored measured value is indicative of the position of the associated ink key after the portion of the doctor blade has moved the predetermined amount away from the portion of the ink roll. The stored measured value corresponds to the lithographic zero position of the ink key. The stored measured value of the ink key is modified each time the portion of the doctor blade moves into contact with the ink roll and then moves the predetermined amount away from the ink roll.

11 Claims, 4 Drawing Sheets

METHOD AND APPARATUS FOR SETTING RESPECTIVE POSITIONS OF INK KEYS

BACKGROUND OF THE INVENTION

1. Technical Field

The present invention relates to setting the respective positions of ink keys in an ink fountain of a printing unit.

2. Background Art

Different ways of setting ink keys in an ink fountain of a printing unit are known. One way to set the ink keys is to move each ink key with an associated actuator. Each ink key is associated with a portion of a doctor blade. The portions of the doctor blade are associated with portions of an ink roll and may be positioned to form a gap between the ink roll and the doctor blade.

When the ink roll rotates, a thin film of ink forms on the ink roll. The thickness of the thin film of ink formed on different portions of the ink roll depends upon the size of the gap between the portions of the doctor blade and the associated portions of the ink roll. The size of the gap varies as a function of the positions of the portions of the doctor blade relative to the associated portions of the ink roll. The position of each portion of the doctor blade relative to its associated portion of the ink roll can be changed by adjusting the ink key associated with the particular portion of the doctor blade. Thus, the thickness of the thin film of ink formed on different portions of the ink roll can be changed by adjusting the ink keys.

The ink keys are typically adjusted manually by a human operator when the printing unit is in a maintenance mode. Typically, each ink key may be adjusted by manually turning a knurled head or the like on the ink key. Also, typically, each ink key may be adjusted by actuation of a bidirectional motor which drives the ink key. While the past practices have been reasonably satisfactory, there is a need for an improved ink key adjustment mechanism.

SUMMARY OF THE INVENTION

The present invention relates to a new and improved ink key adjustment mechanism for adjusting a plurality of ink keys of a printing press ink fountain. In accordance with one aspect of the present invention, the apparatus comprises a plurality of movable ink keys and a plurality of actuatable motors. Each of the actuatable motors is associated with a respective ink key for, when actuated, moving the ink key. A sensing member is associated with each ink key and is movable upon movement of each ink key. A memory stores information indicative of an ink key reference position for each ink key and of a sensing member reference position for each of the sensing members associated with the ink keys. First actuatable means is provided for reading the stored information and actuates the motors to adjust the position of the ink keys to a desired position. Second actuatable means is provided for reading commands for operating each motor to move each ink key in accordance with its stored ink key reference position. Means is provided for reading the position of each sensing member associated with an ink key after actuation of the second actuatable means and for modifying the stored information indicative of the sensing member reference position of each sensing member in accordance with the position of the sensing member after actuation of the second actuatable means.

In accordance with another aspect of the present invention, an apparatus is provided for adjusting a plurality of ink keys of a printing press ink fountain. The apparatus comprises an actuatable actuator associated with each ink key for, when actuated, moving the respective ink key. Sensing means is provided for sensing the position of the ink key and providing a signal indicative thereof. Storing means is provided for storing (i) a predetermined reference value for each ink key, and (ii) information based on a signal provided by the sensing means. Control means is provided for (i) actuating the actuator to move the respective ink key to a reference position based on the predetermined reference value stored in the storing means, (ii) monitoring the signal from the sensing means after the ink key has moved to the reference position based on the predetermined reference value, and (iii) modifying the information stored in the storing means based on the monitored signal from the sensing means. Thereafter, the actuator is actuated to move the respective ink key to a desired position based on the modified information stored in the storing means. Enabling means is provided for enabling the control means to actuate the actuator to move the respective ink key and to modify the information stored in the storing means.

The invention is preferably applied to a lithographic printing press and the reference position is preferably a lithographic zero position for each ink key in the ink fountain. To locate each ink key in its lithographic zero position, each ink key is moved to move the associated portion of a doctor blade into contact with an associated portion of an ink roll and then each ink key is moved to position the associated portion of the doctor blade a predetermined amount away from the associated portion of the ink roll after the portion of the doctor blade moved into contact with the portion of the ink roll. A gap is formed between the portion of the doctor blade and the portion of the ink roll. The gap is of a size so that a just noticeable thin film of ink appears on the outer peripheral surface of the portion of the ink roll while the ink roll is rotating. This position of the ink key is the lithographic zero position of the ink key.

The ink keys may be adjusted to their lithographic zero positions either individually or collectively in groups to adjust the different portions of the doctor blade relative to the associated portions of the ink roll. A first measured electrical value corresponding to the lithographic zero position of each ink key is stored in a computer memory. The first measured electrical value of each ink key is modified each time the associated portion of the doctor blade moves into contact with the associated portion of the ink roll and then moves the predetermined amount away from the portion of the ink roll.

All ink keys have respective desired positions for a given printing job and are adjusted to their desired positions based on their associated lithographic zero positions. The lithographic zero position of each ink key acts as a reference point for adjustment of the ink key. For example, a second measured electrical value may be associated with each ink key and is also stored in the computer memory. The second measured electrical value corresponds to the desired position of the ink key for a given printing job. Since the desired position to which the ink key is adjusted is based on its lithographic zero position, the second measured electrical value is based on the first measured electrical value.

When a particular print job is selected, a microprocessor reads the first and second measured electrical values stored in the computer memory. The microprocessor then processes the first and second measured electrical values to generate a control output signal to move the ink key to its desired position in which the ink key is a predetermined distance away from its lithographic zero position. The predetermined distance that the ink key is away from its lithographic zero position depends upon the particular printing job selected.

If the first measured electrical value corresponding to the lithographic zero position is modified in the manner as described hereinabove and stored in the computer memory, then the actual desired position to which the ink key is moved will also be modified the next time the particular printing job is selected. The actual desired position of the ink key will be modified because the predetermined distance between the lithographic zero position of the ink key and the actual desired position to which the ink key moved remains the same. The first measured electrical values associated with all of the ink keys are modified and stored in the computer memory in the same way.

By modifying the first measured electrical values corresponding to the lithographic zero positions of all of the ink keys and then storing the modified values in the computer memory, a number of advantages results. One advantage is that a common reference point, i.e., the lithographic zero positions of the ink keys, is provided for control algorithms that attempt to maintain a preset color of the printing units. Another advantage is that the ink keys are consistently adjusted to their desired positions relative to their lithographic zero positions so that adjustments of the ink keys based on any subjective observations made by an operator are eliminated.

BRIEF DESCRIPTION OF THE DRAWINGS

The foregoing and other features of the present invention will become apparent to one skilled in the art upon reading the following description of the invention with reference to the accompanying drawings, wherein.

DESCRIPTION OF PREFERRED EMBODIMENT

The present invention is directed to a method and an apparatus for adjusting the positions of ink keys in an ink fountain of a printing press. The present invention may be used in printing presses of different constructions. The description below is merely representative of the present invention as applied to a multicolor lithographic printing press.

Figure 1:
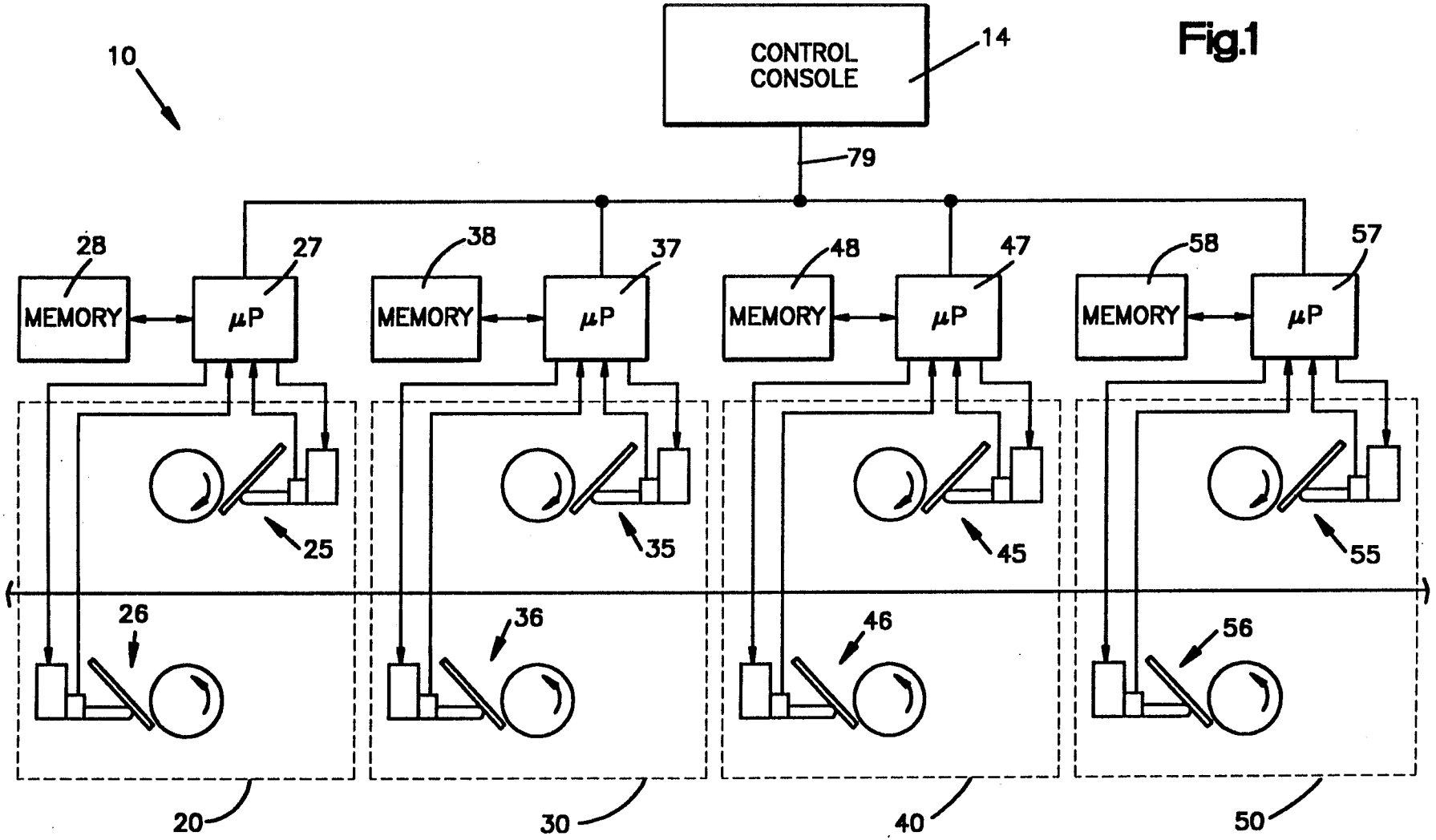
FIG. 1 is a schematic block diagram of the present invention.

Referring to FIG. 1, a multicolor lithographic printing press 10 has a number of printing units. As shown in FIG. 1, four printing units 20, 30, 40, 50 are shown. Although four printing units are shown in FIG. 1, it is understood that a different number of printing units may be incorporated in the printing press 10. The printing units 20, 30, 40, 50 have respective pairs of ink fountains.

Each printing unit includes upper and lower plate cylinders (not shown) and upper and lower blanket cylinders (not shown) which cooperate respectively with the upper and lower plate cylinders. The blanket cylinders print on opposite sides of a web of material advanced through the printing unit. Damping fluid is applied to each printing plate or each plate cylinder, as is known. Also, an ink fountain is associated with each plate cylinder to apply ink to the printing plate on the plate cylinder.

As shown in FIG. 1, the printing unit 20 has the pair of ink fountains 25, 26, the printing unit 30 has the pair of ink fountains 35, 36, the printing unit 40 has the pair of ink fountains 45, 46, and the printing unit 50 has the pair of ink fountains 55, 56. The ink fountains 25, 35, 45, 55, 26, 36, 46, 56 are associated with respective distributed microprocessors 27, 37, 47, 57 communicating with respective computer storage memories 28, 38, 48, 58. Microprocessors are readily available in the commercial market. Their internal structure and operation are well known in the art and, therefore, the microprocessors 27, 37, 47, 57 will not be described in detail herein.

Figure 2:
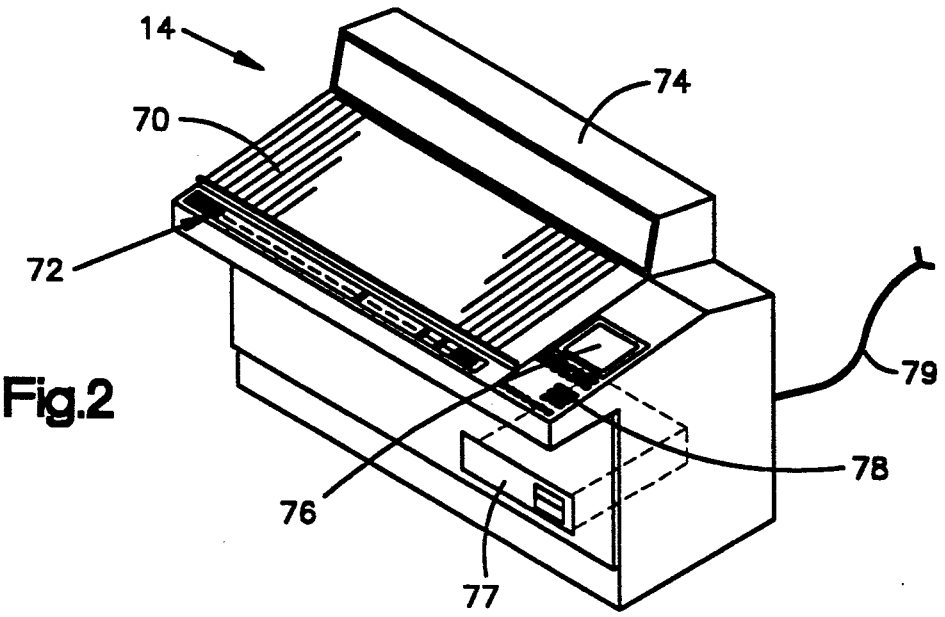
FIG. 2 is a pictorial view of a control console used in the present invention.

Referring to FIG. 2, a control console 14 includes a console computer 77 which communicates via a high speed serial network 79 with the distributed microprocessors 27, 37, 47, 57 and has an operator touch-screen display 76. The control console 14 further includes a sheet inspection area 70 for supporting a printed sheet which bears an image printed by any one or any combination of the printing units 20, 30, 40, 50. The control console 14 also includes an array of manually-operable remote select switches 72 for controlling the positions of ink keys in a selected ink fountain. The manner in which a particular ink fountain is selected will be described later. The array of switches 72 is divided into pairs of switches. Each pair of switches is associated with a respective ink key and a predefined column area of the sheet inspection area 70.

The control console 14 further includes a bargraph display panel 74 for assisting the operator in adjusting ink keys to their desired positions. The display panel 74 has a plurality of columns of light emitting diode ("LED") arrays. The number of columns of LED arrays corresponds to the number of ink keys and the number of pairs o switches 72. Preferably, the number of ink keys is thirty-six and the number of pairs of switches 72 is thirty-six and, therefore, the number of columns of LED arrays in the display panel 74 is also thirty-six.

The touch-screen display 76 provides an operator actuated control for controlling operation of the printing units 20, 30, 40, 50 including selection of an ink fountain and selection of the ink keys in that ink fountain to adjust those ink keys. The display 76 is electrically connected to the computer 77. The display 76 allows the computer 77 to display information to the operator and permits an easy way for the operator to enter information to the computer 77 by simply touching the display screen in appropriate locations prompted by a system software program. Such touch-screen displays are well known in the art and will not be described in detail herein.

The console computer 77, preferably a Model 286 PC AT manufactured by the Qualogy Corporation, San Jose, Calif., is electrically connected with the array of switches 72, the display panel 74, and the touch-screen display 76. The console computer 77 and the touch-screen display 76 cooperate to provide a number of menus and/or graphic illustrations associated with the printing units 20, 30, 40, 50. An operator control board 75 including a number of select switches is located adjacent to the touch-screen display 76.

Each ink fountain has the same structure and operation. For simplicity, the structure and operation of only the ink fountain 25 are described in detail. The ink fountain 25 has an ink fountain roll 21 extending laterally across the printing unit 20. A segmented doctor blade 22 is located adjacent to the ink roll 21 and extend laterally across the ink roll 21.

A gap 23 in the form of an ink film space is formed between an outer peripheral surface 29 of the ink roll 21 and a lower edge 26 of the doctor blade 22. The gap 23 between the ink roll 21 and the doctor blade 22 has been exaggerated for purposes of illustration. The gap 23 can be adjusted at various lateral locations along the ink roll 21 to control locally the amount of ink passing from the ink fountain 25 to printing cylinders (not shown) of the printing unit 10. The doctor blade 22 and the ink roll 21 form an ink reservoir 24 in a manner which is well known in the prior printing art. Ink passes from the ink reservoir 24 through the gap 23 formed between the outer peripheral surface 29 of the ink roll 21 and the lower edge 26 of the doctor blade 22, to establish a controlled thickness of ink on the ink roll 21.

Figure 3:
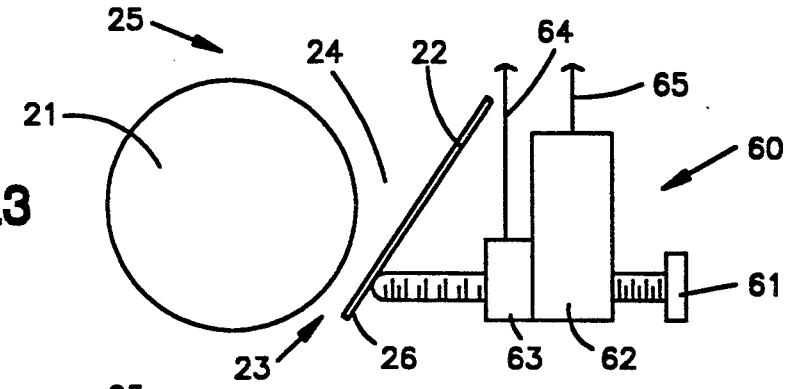
FIG. 3 is a detailed view showing a portion of an ink blade in an arbitrary position relative to a portion of an ink roll.

A plurality of ink flow adjustment devices are disposed at various lateral locations along the ink fountain 25 to press against the doctor blade 22 at those locations to establish and adjust the size of the gap 23 between the ink roll 21 and the doctor blade 22 in each respective vicinity. As shown in FIG. 3, only one ink flow adjustment device, designated with the reference numeral 60, is shown. The ink flow adjustment device 60 includes an ink key 61 having screw threads engaging threads in a fixed portion of the frame of the ink fountain 25. The ink key 61 has a tip portion which pushes against the associated portion of doctor blade 22 to deflect it and to thereby provide locally adjustable control of the gap 23 located between the doctor blade 22 and the ink roll 21. The ink key 61 is driven by a bidirectional actuator motor 62. The motor 62 moves the ink key 61 in and out axially.

A potentiometer 63 has a movable arm mechanically connected with the ink key 61. The potentiometer has a pair of outside electrical terminals and an inside electrical terminal located between the outside electrical terminals, as is known. The inside electrical terminal of the potentiometer 63 is mechanically connected to the movable arm of the potentiometer 63. The position of the movable arm of the potentiometer 63 depends upon the position of the ink key 61. The potentiometer 63 is energized at its outside electrical terminals so that an electrical signal indicative of the position of the ink key 61 is produced at the inside electrical terminal of the potentiometer 63.

The inside terminal of the potentiometer 63 is electrically connected to signal line 64. The electrical signal on line 64 is connected as an input signal to the microprocessor 27. The microprocessor 27 generates a control output signal on signal line 65. The control output signal on line 65 is generated in accordance with a preprogrammed procedure stored in an internal memory of the microprocessor 27. The motor 62 is electrically actuatable to drive the ink key 61 in either direction in accordance with electrical signals received on line 65 from the microprocessor 27.

Figure 5:
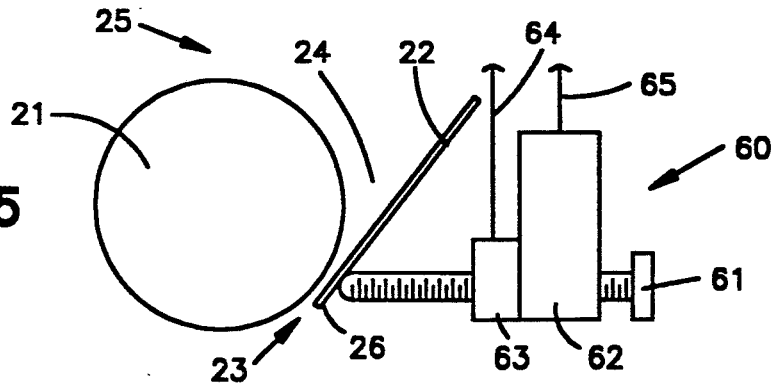
FIG. 5 is a view similar to FIG. 3 in which the portion of the ink blade is a predetermined distance away from the portion of the ink roll.

The lithographic zero position of an ink key is that position of the ink key relative to the associated portion of an ink roll at which a just noticeable thin film of ink appears on the outer peripheral surface of the associated portion of the ink roll while the ink roll is rotating. As an example, the lithographic zero position of only the ink key 61 is shown in FIG. 5. The gap 23 shown in FIG. 5 between the ink roll 21 and the doctor blade 22 has been exaggerated for purposes of illustration. Adjustment of the ink key 61 to its lithographic zero position as shown in FIG. 5 begins from any position such as shown in FIG. 3. When adjustments of ink keys in a particular ink fountain are desired, the operator first selects the ink fountain in which the ink keys are located.

Figure 6:
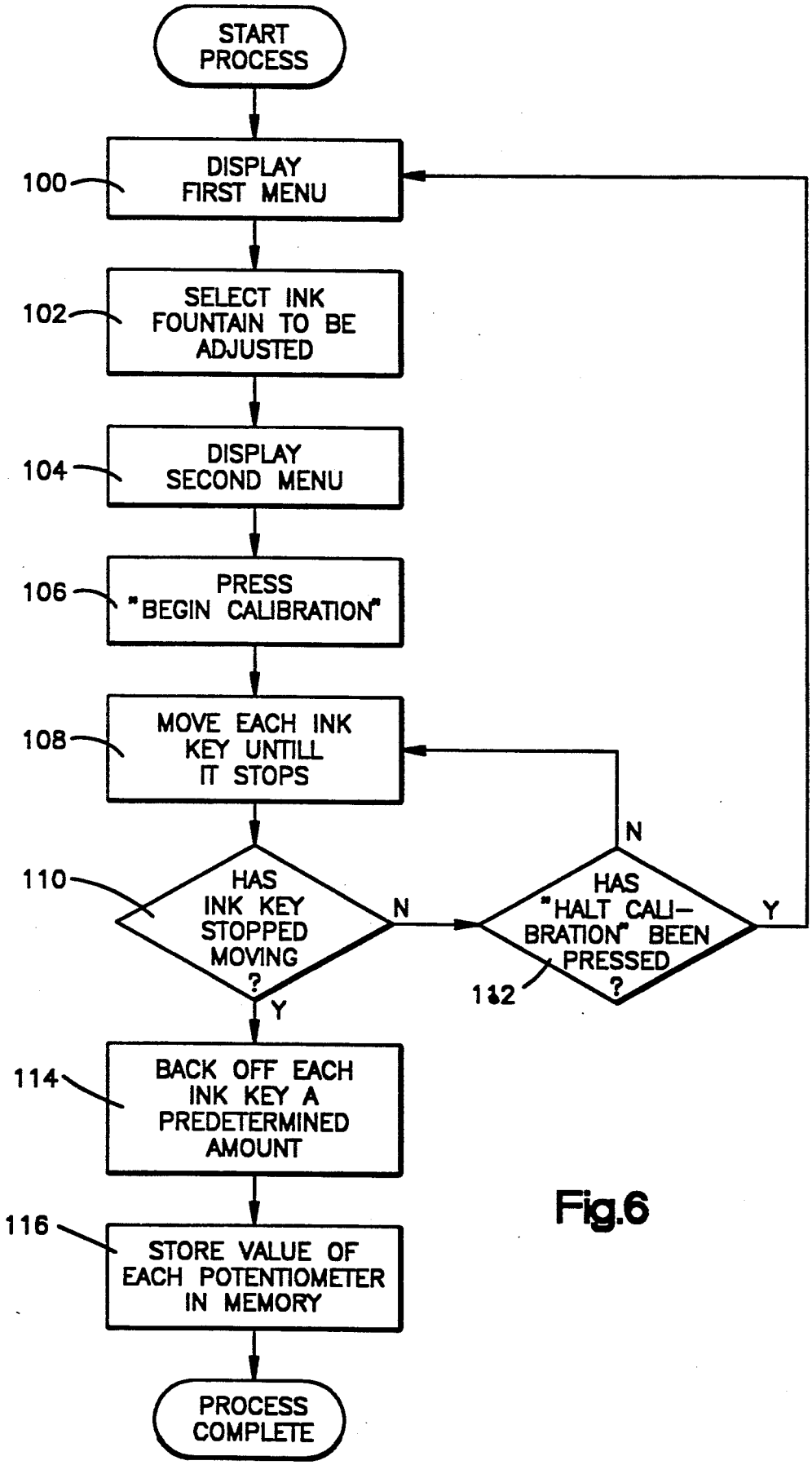
FIGS. 6–7 are flow charts depicting operation of the apparatus in accordance with the present invention.

Referring to FIG. 6, the flow chart depicts the process followed for adjusting ink keys in a particular ink fountain to their respective lithographic zero positions. As an example, assume that the ink keys in the ink fountain 25 are to be selected. In step 100, a first menu is displayed on the touch-screen display 76. The first menu displays a graphics representation of all of the ink fountains in all of the printing units 20, 30, 40, 50. As shown in step 102, the operator selects one of the ink fountains for adjusting the ink keys in the selected ink fountain which is the ink fountain 25 in the present example. The ink fountain 25 is selected by pressing a touch-responsive area on the screen of the touch-screen display 76 in which a graphics illustration of the ink fountain 25 appears. It is contemplated that a touch-responsive area labelled "SELECT ALL" be available on the touch-screen display 76 for, when pressed by the operator, selecting all of the ink fountains in the printing units 20, 30, 40, 50. If all of the ink fountains are selected, then all of the ink keys in all of the ink fountains are selected for adjustments.

After the particular ink fountain to be adjusted has been selected, a second menu is displayed on the touch-screen display 76 as shown in step 104. A touch-responsive area labelled "BEGIN CALIBRATION" appears in the second menu on the touch-screen display 76. When the touch-responsive area labelled "BEGIN CALIBRATION" is pressed as shown in step 106, the console computer 77 communicates information to the microprocessor 27 in the printing unit 20 to indicate to the microprocessor 27 that the ink keys in the ink fountain 25 have been selected for adjustment. The microprocessor 27 then uses this information to provide control signals to adjust all of the ink keys associated with the ink fountain 25 to their respective lithographic zero positions. Each of the ink keys in the ink fountain 25 is adjusted in the same way. For simplicity, adjustment of only the ink key 61 in the ink fountain 25 is described in detail hereinbelow.

Figure 4:
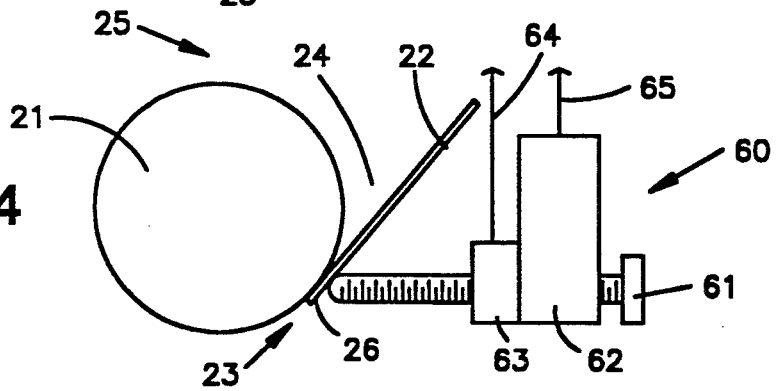
FIG. 4 is a view similar to FIG. 3 in which the portion of the ink blade is in contact with the portion of the ink roll.

With reference to the ink key 61 in the ink fountain 25 as shown in FIG. 3, the microprocessor 27 provides a control signal on line 65 to control operation of the motor 62. In step 108, the motor 62 is operated so that the ink key 61 is adjusted axially in a direction to move the associated portion of the doctor blade 22 from the position as shown in FIG. 3 to a position as shown in FIG. 4 in which the portion of the doctor blade 22 abuts against the associated portion of the ink roll 21.

When the position of the doctor blade 22 abuts against the associated portion of the ink roll 21, the movement of the ink key 61 stops. In step 110, a determination is made if the ink key 61 has stopped its axial movement If the determination in step 110 is negative, then the process proceeds to step 112. A touch-responsive area labelled "HALT CALIBRATION" is available on the touch-screen display 76 while the ink key 61 is being adjusted for stopping any further adjustment if this touch-responsive area is pressed. A determination is made in step 112 if the touch-responsive area labelled "HALT CALIBRATION" is pressed. If the determination in step 112 is affirmative, then the process returns to the start of the process in which the first menu is displayed on the touch-screen display 76. If the determination in step 112 is negative, the process proceeds to step 108 to continue movement of the ink key 61.

If the determination in step 110 is affirmative, the process proceeds to step 114. The electrical value on the inside terminal of the potentiometer 63 stops changing when axial movement of the ink key 61 stops. When the microprocessor 27 determines that the electrical value on the inside terminal of the potentiometer 63 has stopped changing, the process then proceeds to step 114 since the ink key 61 has stopped its movement. In step 114, after the ink key 61 has moved the portion of the doctor blade 22 against the portion of the ink roll 21 as shown in FIG. 4 and stops, the control signal on line 65 from the microprocessor 27 controls the motor 62 so that the ink key 61 is moved in the opposite axial direction to move the portion of the doctor blade 22 a predetermined amount away from the portion of tho ink roll 21 as shown in FIG. 5. A value corresponding to the predetermined amount of movement of the position of the doctor blade 22 away from the portion of the ink roll 21 is stored in the memory 28. As previously mentioned, the ink key 61 in the position as shown in FIG. 5 is in its lithographic zero position.

After the ink key 61 is adjusted to its lithographic zero position as shown in FIG. 5, the electrical signal value appearing at that moment on line 64 from the inside terminal of the potentiometer is read by the microprocessor 27 and stored in the memory 28 as shown in step 116. The same electrical signal value associated with the ink key 61 remains stored in the memory 28 until the ink key 61 is again adjusted to its lithographic zero position in the manner as just described. The electrical signal value stored in the memory 28 and associated with the ink key 61 may be periodically modified by selecting the ink fountain 25 and then pressing the touch-responsive area labelled "BEGIN CALIBRATION" on the touch-screen display 76, as previously described. The stored electrical signal value in the memory 28 is referred to herein as the first measured electrical value.

The microprocessor 27 adjusts the other ink keys (not shown) associated with the ink fountain 25 in the same manner as for the ink key 61. When all of the ink keys in the ink fountain 25 have been adjusted to their lithographic zero positions, the calibration process is complete and a just noticeable thin film of ink appears on the outer peripheral surface of the ink roll 21 while the ink roll 21 is rotating. After all of the ink keys in the ink fountain 25 have been adjusted to their lithographic zero positions and the electrical signal values at the inside terminals of their associated potentiometers have been stored in the memory 28, all subsequent adjustments of the ink keys for a particular printing job are made based on this reference point, i.e., the lithographic zero positions of the ink keys.

Figure 7:
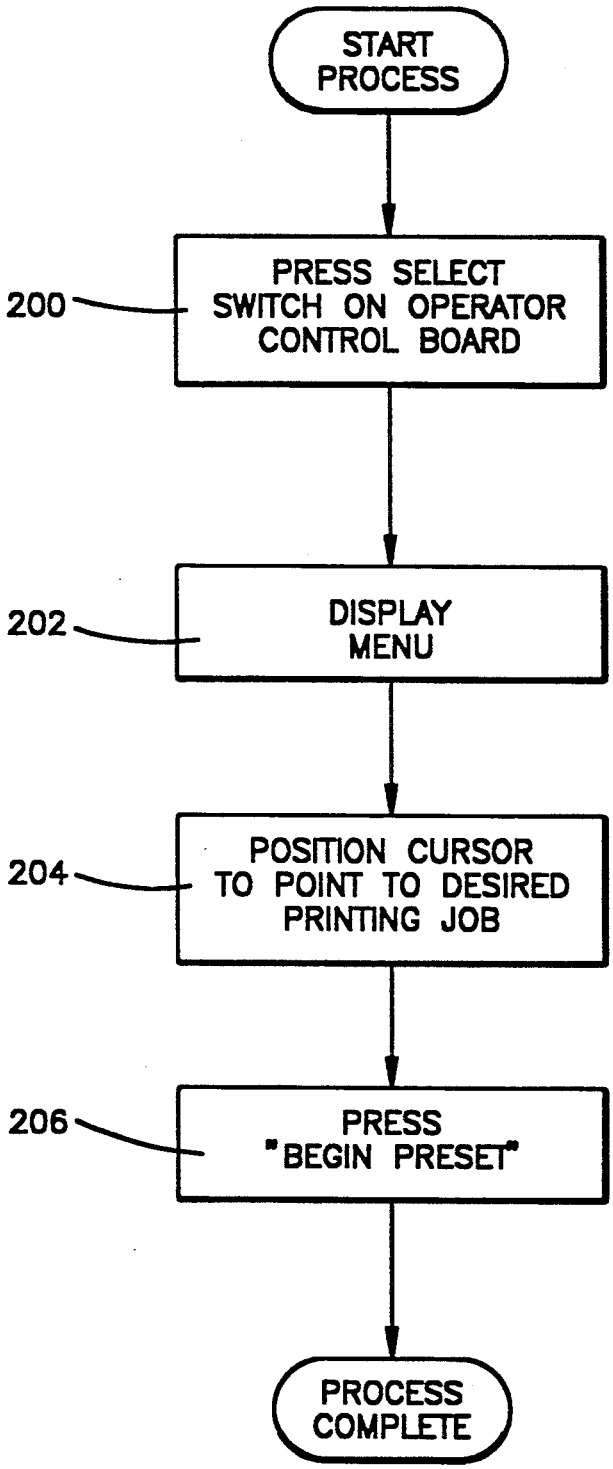

Referring to FIG. 7, the flow chart depicts the process followed for selecting a particular printing job and adjusting ink keys to respective desired positions in accordance with the particular printing job selected. When a particular printing job is to be selected, the operator presses a select switch 80 labelled "PRESET" located in the operator control board 75, as shown in step 200. After the select switch 80 is pressed, a menu appears on the display 76 as shown in step 202. A number of different printing jobs appears in the menu on the touch-screen display 76. Preferably, the number of printing jobs appearing on the touch-screen display 76 is fifteen. A highlighted movable cursor also appears on the touch-screen display 76. The highlighted cursor points to one of the printing jobs appearing on the touch-screen display 76. As shown in step 204, the operator proceeds to select the desired printing job by pressing a certain touch-responsive area appearing on the touch-screen display 76 to move the highlighted cursor to a position so that the highlighted cursor points to the desired printing job to be selected.

After the highlighted cursor is positioned and points to the desired printing job, a touch-responsive area labelled "BEGIN PRESET" appearing on touch-screen display 76 is pressed as shown in step 206. When the touch-responsive area labelled "BEGIN PRESET" is pressed, the console computer 77 communicates information to the distributed microprocessors 27, 37, 47, 57 in the printing units 20, 30, 40. 50 to indicate to the microprocessors 27, 37, 47, 57 that a particular printing job has been selected. The microprocessors 27, 37, 47, 57 then uses this information to adjust all of the ink keys in all of the ink fountains of the printing units 20, 30, 40, 50 to their desired positions for the particular printing job selected based on the lithographic zero positions of the ink keys.

Each ink key is adjusted to its desired position relative to its lithographic zero position in the same way. For simplicity, adjustment of only the ink key 61 to its desired position is described. As previously mentioned, the first measured electrical value stored in the memory 28 is associated with the lithographic zero position. A second measured electrical value associated with the desired position of the ink key 61 for the selected printing job is also stored in the memory 28.

After the microprocessor 27 receives the information from the console computer 77 to adjust the ink key 61 in accordance with the selected printing job, the microprocessor 27 reads the first and second measured electrical values associated with the ink key 61 and generates a control output signal on line 65 to control the motor 62 so as to move the associated portion of the doctor blade 22 relative to the associated portion of the ink roll 21. More specifically, the motor 62 operates to move the ink key 61 to the desired position which is a predetermined distance away from the lithographic zero position. The predetermined distance between the desired position and the lithographic zero position of the ink key is based upon the second measured electrical value which, in turn, is based upon the first measured electrical value. Thus, the actual position to which the ink key 61 is moved when it is moved to its desired position depends upon the lithographic zero position of the ink key 61.

From the above description, it should be apparent that the information stored in the memory 28 corresponding to the lithographic zero positions of the ink keys in the ink fountain 25 is modified each time the ink keys in the ink fountain 25 are adjusted to their lithographic zero positions. By allowing the information stored in the memory 28 indicative of the lithographic zero positions of the ink keys in the ink fountain 25 to be modified, the reference point based on which the ink keys are adjusted for a particular print job changes. When the reference point based on which the ink keys are adjusted for a particular printing job is modified in the manner as just described, machine wear or the like which would cause inaccuracies in ink key positions and thus poor quality printing are compensated.

By establishing a reference point based on which ink keys in an ink fountain are to be adjusted for a selected printing job and then periodically modifying the reference point in the manner as described hereinabove, a number of advantages result. One advantage is that a common reference point is provided for control algorithms that attempt to maintain a preset color of the printing units in spite of machine wear or the like. This common reference point is the lithographic zero positions of the ink keys. Another advantage is that the ink keys in an ink fountain are consistently adjusted to their desired positions relative to the reference point, i.e., their lithographic zero positions so that adjustments of the ink keys based on any subjective observations made by an operator are eliminated.

It is conceivable to have a panel of select switches 78 located adjacent to the touch-screen display 76 for selecting the particular ink fountain to be adjusted. Also, it may be possible to have a keyboard by which the operator can select the particular ink fountain or ink fountains to be adjusted. Further, it may be possible to have a combination of select switches, a keyboard, and/or a touch-screen display at the same time.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for moving ink keys relative to an outer surface of an ink roll, said apparatus comprising:

a plurality of movable ink keys;

a plurality of actuatable motors, each of said actuatable motors being associated with a respective ink key for, when actuated, moving the ink key;

a sensing member associated with each ink key and movable upon movement of each ink key;

a memory for storing information indicative of an ink key zero reference position for each ink key and for storing information indicative of a sensing member reference position for each of the sensing members associated with the ink keys;

first actuatable means for reading the stored information and actuating said motors to adjust the position of the ink keys to a desired position;

second actuatable means for storing commands for operating each motor to move each ink key first into contact with the outer surface of the ink roll and then away from the outer surface of the ink roll in accordance with the information indicative of its stored ink key zero reference position; and means for reading the position of each sensing member associated with an ink key after actuation of said second actuatable means and for modifying the stored information indicative of the sensing member reference position of each sensing member in accordance with the position of said sensing member after actuation of said second actuatable means.

2. The apparatus of claim 1 wherein said sensing member includes a potentiometer having outside terminals and an inside terminal located on a mechanical arm mechanically connected with the respective ink key, said arm moving in response to movement of the ink key and having a position which varies as a function of the position of the ink key, said potentiometer having its outside terminals electrically energized and to thereby provide an electrical signal on the inside terminal indicative of the position of the ink key.

3. An apparatus for adjusting a plurality of ink keys of a printing press ink fountain relative to an outer surface of an ink roll, said apparatus comprising:

an actuatable actuator associated with each ink key for, when actuated, moving the respective ink key;

sensing means for sensing the position of the ink key and providing a signal indicative thereof;

storing means for storing (i) a predetermined zero reference value for each ink key, and (ii) information based on a signal provided by said sensing means;

control means for (i) actuating said actuator to move the respective ink key first into contact with the outer surface of the ink roll and then away from the outer surface of the ink roll to a reference position based on said predetermined zero reference value stored in said storing means, (ii) monitoring said signal from said sensing means after the ink key has moved to said reference position based on said predetermined zero reference value, (iii) modifying said information stored in said storing means based on said monitored signal from said sensing means, and (iv) thereafter actuating said actuator to move the respective ink key to a desired position based on said modified information stored in said storing means; and enabling means for enabling said control means to actuate said actuator to move the respective ink key and for enabling said control means to modify said information stored in said storing means.

4. The apparatus of claim 3 wherein said actuatable means includes an actuatable motor for each ink key, said motor being operatively connected with its respective ink key for moving the ink key in and out axially.

5. The apparatus of claim 4 wherein said sensing means includes a potentiometer having outside terminals and an inside terminal located on a movable arm mechanically connected with the respective ink key, said arm moving in response to movement of the ink key and having a position which varies as a function of the position of the ink key, said potentiometer having its outside terminals electrically energized and to thereby provide an electrical signal on the inside terminal indicative of the position of the ink key.

6. The apparatus of claim 3 wherein said storing means is a computer memory.

7. The apparatus of claim 3 wherein said enabling means includes a touch-screen display mounted on a control console.

8. The apparatus of claim 7 wherein said control means includes a microprocessor responsive to operation of said touch-screen display and communicating with said storing means.

9. A method of moving portions of a doctor blade relative to an ink roll of a printing unit, said method comprising the steps of:

moving each of the portions of the doctor blade into contact with the ink roll;

moving each of the portions of the doctor blade a first predetermined amount away from the ink roll after the portions have moved into contact with the ink roll; and storing a first measured value associated with each of the portions of the doctor blade corresponding to the position of the particular portion of the doctor blade after the portion has moved the first predetermined amount away from the ink roll, the stored first measured value corresponding to the lithographic zero position of the portion of the doctor blade, the stored first measured value of each portion being modified each time the portion of the doctor blade moves into contact with the ink roll and then moves the first predetermined amount away from the ink roll.

10. A method of claim 9 further comprising the step of moving each of the portions of the doctor blade a second predetermined amount away from the lithographic zero position of the associated portion of the doctor blade after the portions of the doctor blade have moved to their lithographic zero positions.

11. A method of claim 10 further comprising the step of storing a second measured value associated with each of the portions of the doctor blade corresponding to the position of the particular portion of the doctor blade after the portion has moved the second predetermined amount away from the lithographic zero position.

* * * * *